United States Patent [19]

Etes

[11] 4,140,243

[45] Feb. 20, 1979

[54] APPARATUS FOR VENDING NEWSPAPERS, MAGAZINES AND THE LIKE

[76] Inventor: Elmer G. Etes, 1436 Blaisdell, Rockford, Ill. 61103

[21] Appl. No.: 807,562

[22] Filed: Jun. 17, 1977

[51] Int. Cl.[2] ..... B65H 3/22

[52] U.S. Cl. ..... 221/215; 221/227; 221/228; 221/232; 221/248

[58] Field of Search ..... 221/215, 227, 228, 232, 221/248

[56] References Cited

U.S. PATENT DOCUMENTS

| | | | |
|---|---|---|---|
| 3,114,475 | 12/1963 | Etes | 221/103 |
| 3,168,212 | 2/1965 | Edwards | 221/227 X |
| 3,263,859 | 8/1966 | Searle | 221/227 |

*Primary Examiner*—Allen N. Knowles
*Attorney, Agent, or Firm*—Morsbach & Pillote

[57] ABSTRACT

A machine for vending newspapers, magazines and the like including a housing having a dispensing opening and a dispensing gate in the opening, a tray for supporting a stack of papers and tray elevating mechanism for urging the tray upwardly until the top paper in the stack is adjacent the level of the dispensing opening, a feed mechanism operative through a dispensing stroke to feed the end paper at least part way off the stack into the dispensing opening, and gate control mechanism operative to prevent opening of the gate between dispensing cycles and operative when the feed mechanism is moved in its dispensing stroke to enable opening of the gate, the gate control mechanism also including mechanism operative whenever the dispensing gate is held open after the feed mechanism has completed its dispensing stroke, for preventing elevation of the support tray toward the dispensing opening to thereby impede the access to the papers in the stack through the dispensing opening.

10 Claims, 4 Drawing Figures

212
164c
164
211
229
221
93
164a
29
121
58
159
161
118
95
163
163a
164b
117
32
159
115a
28
116
156
126
127
230
125
158
158a
115
102
79
231
232
114
81
213
26
119
117
82
116
232
215

APPARATUS FOR VENDING NEWSPAPERS, MAGAZINES AND THE LIKE

BACKGROUND OF THE INVENTION

In the U.S. patent to Elmer G. Etes, No. 3,114,475, issued Dec. 17, 1963, there is disclosed a machine for vending newspapers, magazines and the like including a housing having a generally horizontal dispensing opening, a dispensing gate movable between open and closed positions in the dispensing opening, a paper support tray for supporting a stack of generally horizontally disposed papers, tray elevating means for urging the tray upwardly to elevate the tray toward the panel, and a feed mechanism operable through a dispensing cycle to move the top paper at least part way off the stack and into the dispensing opening. That machine also included a mechanism engageable with a support tray in all operative positions for shifting the support tray downwardly during a dispensing stroke a distance sufficient to at least partially relieve the pressure between the top paper and the panel to facilitate dispensing.

The prior vending machine had mechanism operative to lock the dispensing gate against opening between dispensing cycles and operative when the feed mechanism was moved in its dispensing stroke to release the gate lock and enable opening of the dispensing gate for the passage of the top paper. This mechanism operated satisfactorily to dispense papers. However, the dispensing gate could be held open after the gate lock was released, by inserting a hand or other object to the dispensing opening. With the dispensing gate held open, an instrument such as a hook, wire or the like could be inserted through the dispensing opening to engage and strip the top papers from the stack and the tray elevating means operated to continue elevating the stack of papers so that it was possible to sequentially strip the entire stack of papers from the machine.

In order to inhibit unauthorized withdrawal of papers in the stack through the dispensing opening, a stop pin was provided in the above apparatus and normally positioned in the path of movement of the top paper, which stop pin was moved to its inoperative position only during movement of the dispensing mechanism in a dispensing stroke. When the stop pin was in position extending crosswise of the stack adjacent the top paper, it would function to impede withdrawal of the papers. However, the stop pin could be rendered ineffective by inserting another coin and operating the dispensing mechanism until it elevated the stop pin. The dispensing mechanism could then be held in that position to hold the stop pin in its raised position. Alternatively, it was possible to manually raise the stop pin through an instrument inserted through the open dispensing gate.

SUMMARY OF THE INVENTION

It is the object of the present invention to overcome the problem of theft of papers through the dispensing opening in vending machines of the type disclosed in my prior patent by providing a mechanism for preventing elevation of the papers to the level of the dispensing opening whenever the dispensing door is held open. Accordingly, the present invention provides a machine for vending newspapers and the like including a housing having a generally horizontal dispensing opening and a dispensing gate mounted for movement between open and closed positions in the dispensing opening, a newspaper support tray for supporting a stack of generally horizontally disposed papers and tray elevating means yieldably urging the support tray upwardly to elevate the stack until the top paper is adjacent the level of the dispensing opening, a feed mechanism operable through dispensing cycle including a dispensing stroke to move the top paper at least part way off the stack and into the dispensing opening, and dispensing gate control means operative to prevent opening of the dispensing gate between dispensing cycles and operative when the feed mechanism is moved in its dispensing stroke to enable opening of the dispensing gate for the passage of the top paper therethrough, the dispensing gate control means also including means operative whenever the dispensing gate is held open after the feed mechanism has completed its dispensing stroke for preventing elevation of the support tray toward the level of the dispensing opening to thereby impede access to the papers in the stack through the dispensing opening.

The vending machine advantageously includes a tray shifting means engageable with the support tray and operable to shift the support tray downwardly a selected distance sufficient to at least partially relieved the pressure between the top paper and the dispensing panel, and the mechanism for preventing elevation of the support tray when the dispensing gate is held open is connected to the tray shifting mechanism.

These, together with other objects and advantages of this invention will be more readily understood by reference to the following detailed description when taken in connection with the accompanying drawings wherein.

Figure 1:
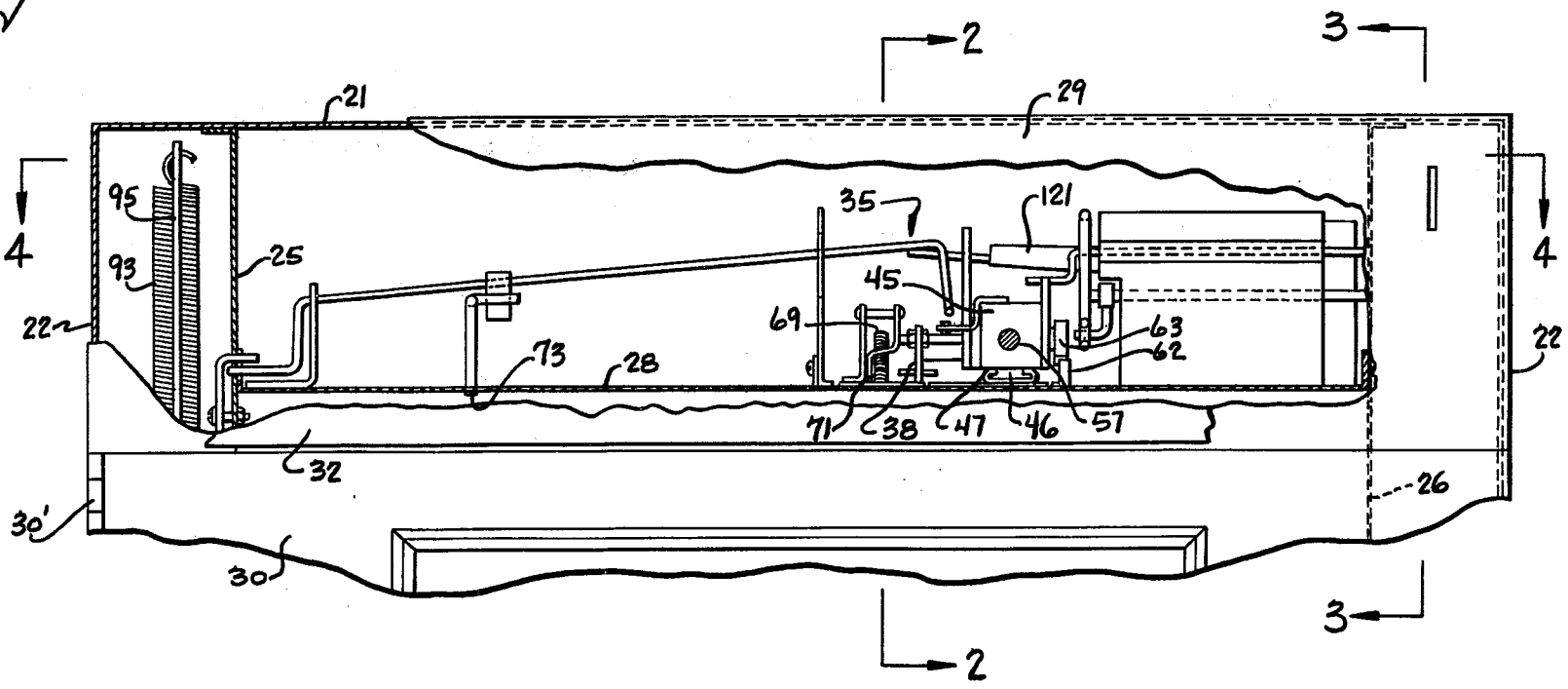
FIG. 1 is a fragmentary front view of the newspaper vending machine with parts broken away and shown in section to illustrate details of construction.

The vending machine of the present invention is an improvement in vending machines of the type disclosed in my Pat. No. 3,114,475, issued Dec. 17, 1963, for "Vending Machine", and reference is hereby made to the aforementioned patent for a more complete description. In general, the vending machine is enclosed in a housing which includes an outer shell having a bottom 20, a top 21, space sides 22 and a rear wall 23. An inner frame, forming part of the housing, supports the various parts of the dispensing machine and is arranged for insertion and removal as a unit from the outer shell. The inner frame includes spaced side walls 25 and 26, a bottom wall 27 and a top dispensing panel 28 extending between the side walls and spaced below the top of the outer shell to separate the outer shell into an upper compartment for receiving the dispensing mechanism and a lower compartment for storing papers. A front panel 29 extends upwardly from for forward edge of the dispensing panel 28 and across the upper portion of the outer shell to form an enclosure. A door designated generally by the numeral 30 is attached by a hinge 30' to one side wall of the outer shell and is arranged, when closed, to extend across the open front face of the housing. The upper edge of the door 30 is spaced below the dispensing panel 28 to form a dispensing opening 31 therebetween a rain shield or deflector 32 is attached to the upper edge of the front panel 29 and extends downwardly and outwardly over the dispensing opening 31 to inhibit entrance of rain, snow and the like. With this arrangement, the door 30 can be swung open about its hinge 30' and the inner frame then inserted or withdrawn as a unit from the outer shell. Any suitable means, not shown, may be provided for locking the inner frame to the outer shell to prevent unauthorized removal of the same.

Figure 4:
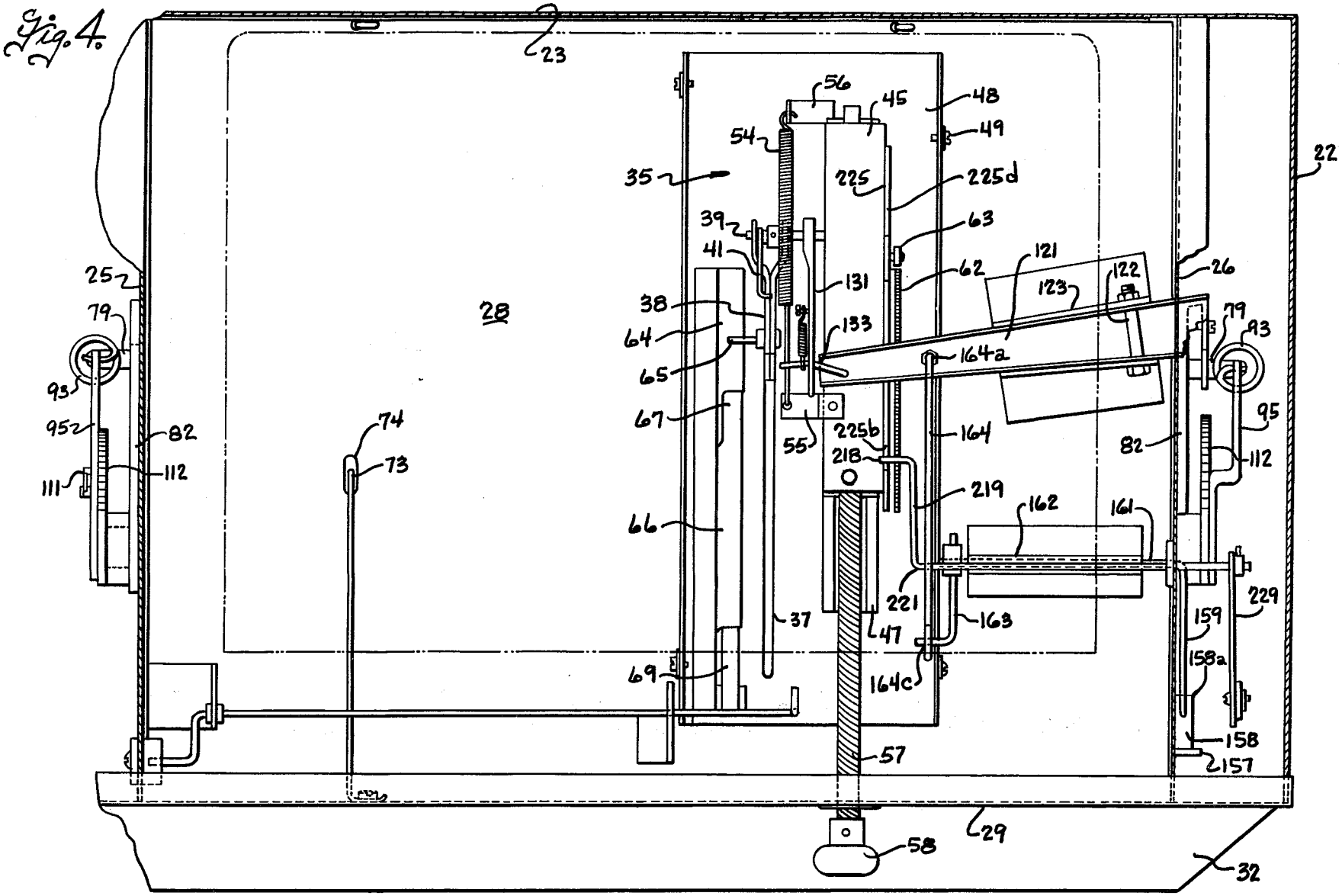
FIG. 4 is a horizontal sectional view through the newspaper vending machine taken on the plane 4—4 of FIG. 1.

A dispensing mechanism 35 is mounted on the top dispensing panel 28 and, in general, includes a feed finger 36 (FIG. 2) which is mounted for movement toward and away from the dispensing opening 31 and which is extended through a slot 37 in the panel to impale the end paper on the stack and advance the same towards the dispensing opening. As shown, the feed finger 36 is attached to a feed arm 38, which arm is pivotally mounted on a pin 39 at the end remote from the feed finger. The arm supports the feed finger for movement in a plane transverse to the panel 28, to permit extension and retraction of the feed finger through the slot 37 and, as best shown in FIG. 4, a spring 41 is provided to normally urge the arm downwardly and extend the feed finger through the slot 37. The pin 39 is attached to a carriage 45 having guides 46 on the underside which are slidably mounted in a trackway 47. The trackway 47 is conveniently secured to a tray 48 which is removably attached to the panel 28 as by fasteners 49. The trackway supports the carriage for reciprocation toward and away from the dispensing opening and the carriage is yieldably urged in a direction away from the dispensing opening by a spring 54 having one end attached by a bracket 55 to the carriage and the other end attached by a bracket 56 to the tray. A manually operable carriage actuating element 57 is attached to the carriage and extends through an opening in the front panel 29 of the housing and has a knob 58 at its outer end to enable manual drawing of the carriage toward the dispensing opening, to thereby move the feed finger forwardly through a dispensing stroke. A ratchet bar 62 is mounted on the tray 48 and the pawl 63 is swingably mounted on the carriage and cooperates with the ratchet bar to prevent retrograde movement of the carriage after the carriage has begun its forward or dispensing stroke, and to also prevent retrograde movement of the carriage after the carriage has begun its return stroke, to thereby prevent an operator from oscillating the carriage intermediate the ends of its stroke in an attempt to withdraw more than one paper in a dispensing cycle.

Figure 2:
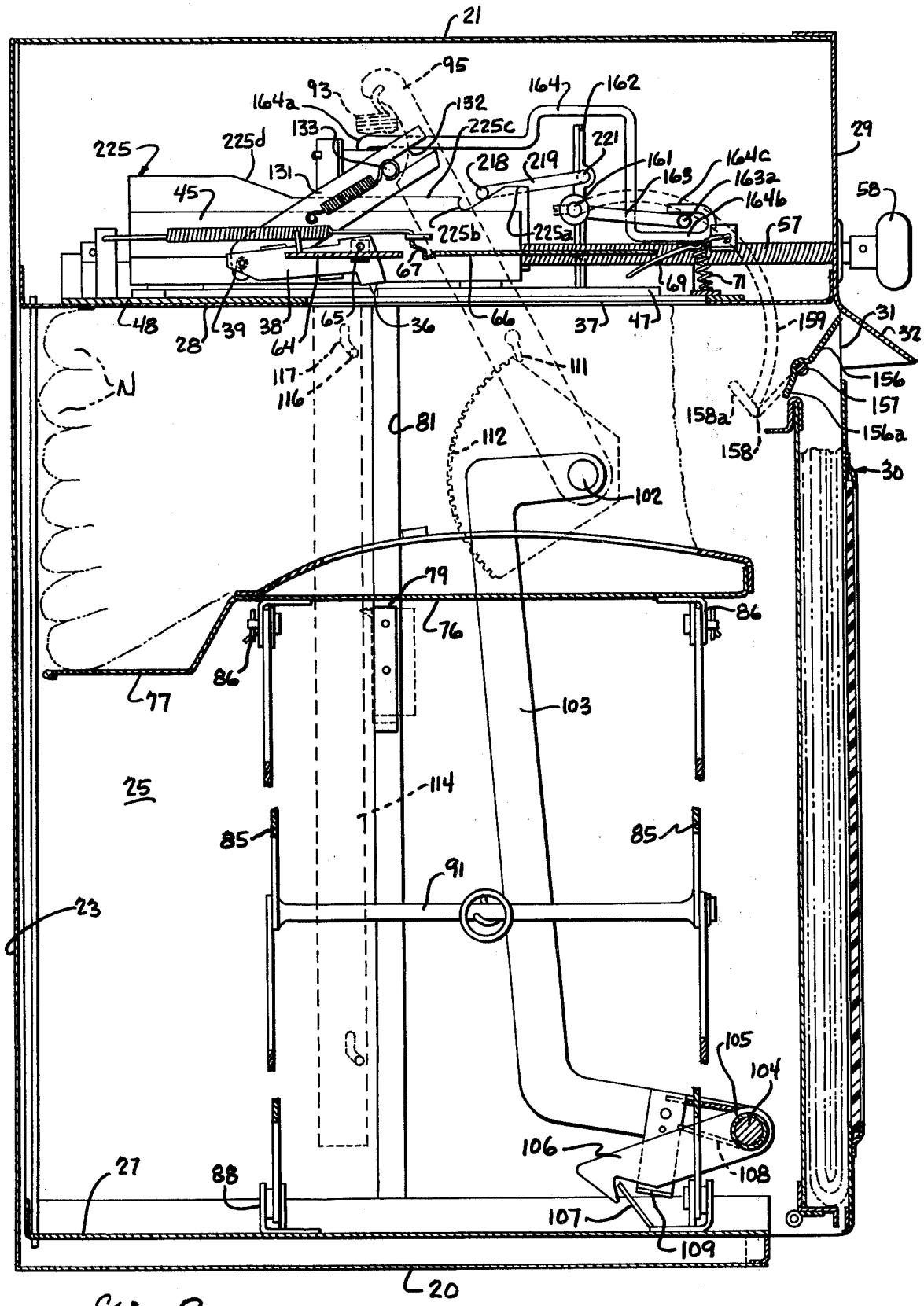
FIG. 2 is a vertical sectional view through the newspaper vending machine taken on the plane 2—2 of FIG. 1.

The feed arm 38 has a cam follower 65 on the end adjacent the feed finger 36 and a cam track 66 is attached to the tray alongside the feed slot 37 for positively extending the feed finger through the slot to thereby impale the end paper with a controlled depth of penetration. As best shown in FIGS. 2 and 4, the cam follower 65 on the feed arm is normally supported on a ledge 64 at one end of the cam track 66. The cam track 66 has a cam face 67 adjacent its rear end inclined downwardly and forwardly to positively force the cam follower and the feed finger downwardly during forward movement of the feed finger toward the dispensing opening. During the dispensing stroke, the follower rides on the dwell portion at the underside of the cam track 66 and the length of the feed finger 36 is selected so that the feed finger extends a preselected distance, for example about three-sixteenth", below the underside of the panel 28 and into the top paper therebelow. A cam plate 69 is provided at the forward end of the cam track and extends forwardly and upwardly to retract the feed finger out of the slot. The cam plate 69 is yieldably urged against the underside of the cam track 66 by a spring 71 so that, during return movement of the feed finger in a direction away from the dispensing opening, the cam follower is guided onto the dwell portion at the upper side of the cam track.

As disclosed in the aforementioned patent, the feed slot 37 and feed finger 36 are advantageously located at a point laterally offset from the center of the stack of papers so that the feed finger moves the end paper off the stack with a "twisting" motion. A presser finger 73 is mounted to extend through an opening 74 in the panel 28 at a point laterally offset to the other side of the center of the stack. The presser finger is yieldably urged into engagement with the end paper in the stack and inhibits sliding movement of the paper at that point so that the paper can pivot or twist relative to the stack about the presser finger as the feed finger moves the other end portion of the paper toward the dispensing opening. The presser finger thus aids in assuring movement of the end paper with a twisting motion relative to the stack, which twisting motion aids in breaking the bond between the end paper and the paper adjacent thereto so that only one paper is dispensed at a time.

A stack of newspapers, designated generally by the letter "N" is supported on a tray 76 and provision is made for elevating the tray toward the panel 28 until the face of the top paper in the stack engages the panel. The newspapers are preferably stacked on the tray with the folded edges located remote from the dispensing opening and the rear portion 77 of the tray is advantageously offset below the body of the tray to accommodate the increased bulk of the folds in the stack of papers. In addition, the top face of the tray is preferably formed with a convex figuration from front to rear with the apex of the convex portion of the tray located slightly forwardly of the cam face 67 on the cam track 66. Straps 79 extend from opposite ends of the tray and through a guide slot 81 in the respective side walls 25, 26, and slotted reinforcing plates 82 are attached to the side walls around the slots 81 to laterally guide the tray during vertical movement toward and away from the panel 28. The tray is maintained in an attitude generally paralleling the panel as it moves toward and away therefrom by front and rear sets of articulated bars forming front and rear lazy-tongs type assemblies designated generally by the numeral 85. The upper ends of the lazy-tongs assemblies are connected by brackets 86 to the tray and the lower ends are connected by the brackets 88 to the bottom wall 27. A tie bar 91 extends between the front and rear sets of lazy-tongs assemblies to effect elevating and lowering of the front and rear ends of the tray in unison.

Figure 3:
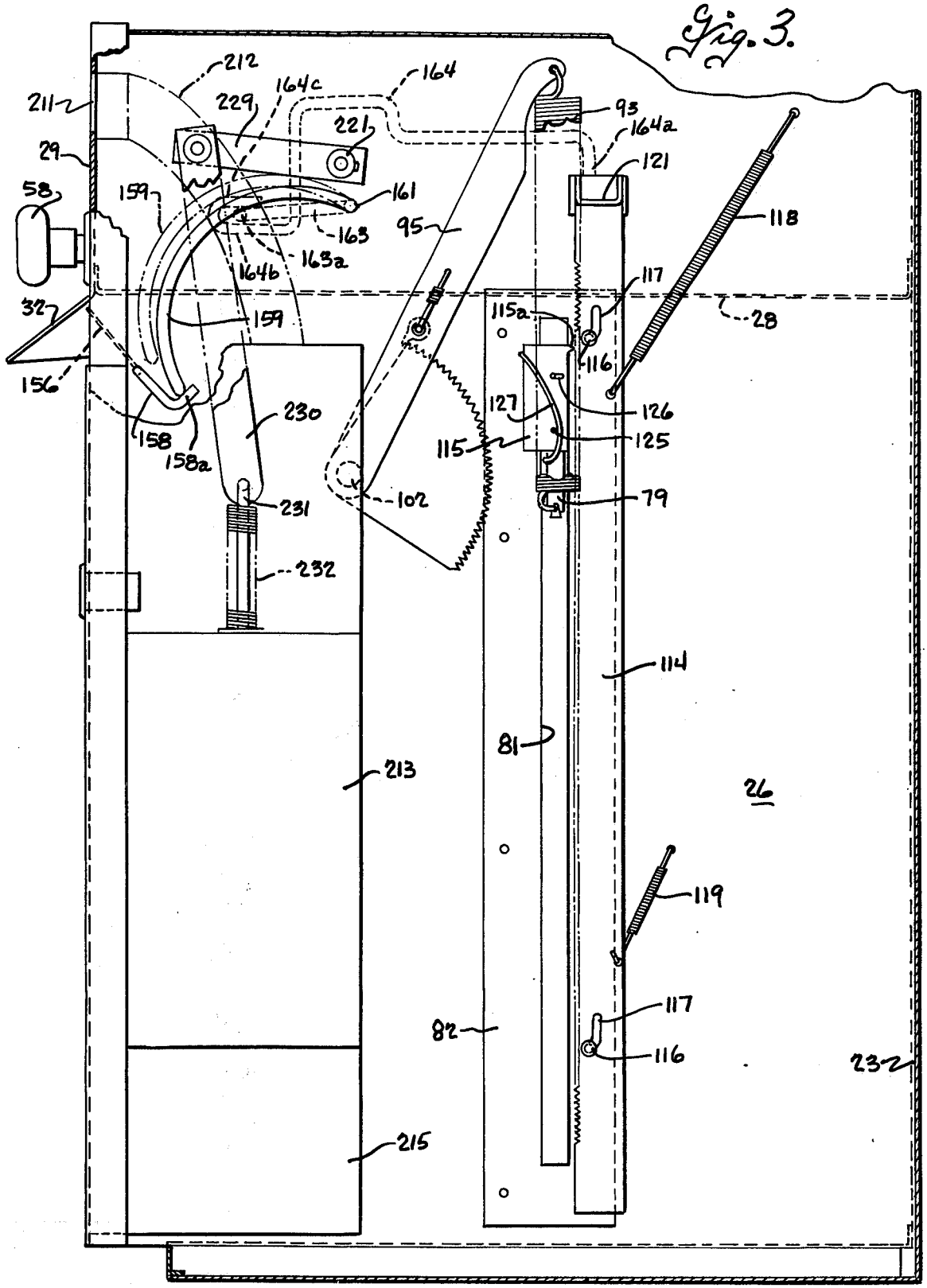
FIG. 3 is a vertical sectional view through the vending machine taken on the plane 3—3 of FIG. 1.

The tray 76 is yieldably urged upwardly toward the panel 28 with a controlled pressure sufficient to counter-balance the weight of the tray and the stack of papers thereon and to additionally press the top paper against the underside of the panel with a slight pressure sufficient to compact the top paper. For this purpose, a tension spring 93 is provided at each end of the tray with the lower end of each spring attached to the straps 79 and the upper end of each spring attached to a respective arm 95. The arms are normally disposed in a raised position as shown in FIG. 2 and 3 so that, when the tray is in its lowermost position and supports a full stack of papers, the springs are extended to a maximum amount, the extension decreasing as the stack of papers is depleted and the tray moves upwardly. The springs 93 are selected in accordance with the weight of the full stack of papers to be handled by the machine, to overbalance the weight of the full stack of papers when the tray is in its lowermost position by an amount sufficient to lightly press the top paper against the panel, and to apply a progressively decreasing pressure to the tray as a stack of papers is depleted and the tray moves upwardly until the tray reaches a substantially fully elevated position with only one paper on the tray. At that time the springs are arranged to apply only a light upward pressure to the tray sufficient to compact the top paper.

The arms 95 are supported for vertical swinging movement on trunnions 102 rotatably supported in the side walls 25 and 26 and generally L-shaped levers 103 are non-rotatably secured to the trunnions and disposed at the inner side of the side walls. The levers 103 extend downwardly along the inner face of the side walls and are interconnected at the lower ends by a cross bar 104 which extends across the lower portion of the housing adjacent the front sides. A sleeve-like handle 105 surrounds the bar and latches 106 are attached to the sleeve handle for movement therewith and cooperate with keepers 107 on the bottom wall 27 to latch the levers in the position shown in FIG. 2. A spring 108 engages the levers 103 and the latches 106 to yieldably urge the latches to the latched position and a stop 109 is provided on each lever to engage the latches as shown in FIG. 2. Thus, the handle 105 can be grasped by one hand and turned slightly in a clockwise direction as viewed in FIG. 2 to release the latches and the handle can then be pulled outwardly to swing the levers 103 about trunnions 102 to thereby lower the arms and tray 76. After the stack of papers has been positioned on the tray, the handle 105 is pushed downwardly to return the levers to the position shown in FIG. 2, at which time the latches engage the keepers to latch the arms in their raised position. In order to facilitate raising of the arms in progressive fashion against the tension of the elevating spring, a pawl 111 is provided on each arm and cooperates with a fixed toothed sector plate 112 disposed concentric with the trunnions 102. The pawls 111 operate to prevent retrograde movement of the arms during raising of the arms.

Provision is made for partially relieving the pressure between the top paper in the stack and the dispensing panel 28, after the feed finger 36 has been impaled into the top paper, to thereby facilitate subsequent sliding of the top paper off the stack. For this purpose, a toothed bar 114, herein sometimes referred to as a rack bar, is disposed alongside the vertically extending guideway 81 in the panel 26. A pawl 115 is mounted on one of the straps 79, and the bar 114 is mounted by means of pins 116 and angulated guideways 117 for movement sequentially to the left as viewed in FIG. 3 into engagement with the pawl and then downwardly, to shift the pawl downwardly in response to downward movement of the bar 114. Bar 114 is normally urged upwardly and to the right by diagonally extending tension springs 118 and 119. A lever 121 is pivotally mounted intermediate its ends by a pin 122 on brackets 123 attached to the panel 28. The outer end of the lever 121 engages the upper end of the bar 114 for moving the latter downwardly, and mechanism is provided for elevating the inner end of the lever in response to movement of the feed finger in a dispensing stroke.

As shown in FIG. 3, the nose portion **115*a* of the pawl 115 is not only spaced a slight distance from the toothed bar 114 and, when the bar is moved downwardly, the angulated slot 117 and pins 116 sequentially move the bar into engagement with the pawl and thereafter move the pawl downwardly to depress the tray. The pawl is supported for limited lateral shifting movement as by a pin and slot construction 125, 126 shown in FIG. 3, to accommodate the lateral movement of the bar after the bar engages the pawl and a spring 127** is provided to maintain a yieldable pressure between the pawl and the toothed bar, after the bar has moved into engagement with the pawl.

The lever 121 is operated in response to movement of the feed finger to a dispensing stroke and for this purpose an arm 131 is mounted on the pin 39 for vertical swinging movement. The arm has a forked forward end 132 arranged to engage a finger 133 on the inner end of the lever 121, as the carriage 45 is moved forwardly in a dispensing stroke. The arm swings upwardly as the carriage moves forwardly, to rapidly elevate the inner end of the lever. The initial upward movement of the inner end of the lever accommodates the lost motion between the outer end of the lever 21 and the toothed bar 114 and also the lost motion that occurs during lateral shifting of the bar into engagement with the pawl 115, and these parts are so arranged that the lever 121 does not produce substantial downward shifting movement of the tray until after the feed finger engages the cam face 67 and is forcibly impaled into the compacted top paper on the stack. Thereafter, further forward movement of the carriage advances the feed finger towards the dispensing opening and simultaneously elevates the inner end of the lever 121 to depress the bar 114 and the tray 76 a distance sufficient to at least partially relieve the pressure between the end paper and the panel. Since the folded papers are somewhat spongy, they tend to expand slightly when the pressure is relieved so that the end paper does not drop away from the panel.

A dispensing gate 156 is mounted on a rod 157 in the dispensing opening 31, for movement into and out of position substantially closing the dispensing opening. A gate control mechanism is provided which is operative to lock the dispensing gate against opening between dispensing cycles and which is operative when the feed mechanism is moved in its dispensing stroke to enable opening of the dispensing gate for the passage of top paper therethrough. Once the gate is unlocked by the dispensing mechanism, it can thereafter be held open as by the insertion of a hand or other object into the dispensing opening and, in accordance with the present invention, the gate control mechanism is also operative whenever the dispensing gate is held open after the feed mechanism has completed its dispensing stroke to prevent elevation of the support tray toward the level of dispensing opening. This prevents elevation of the stack of papers to the level of the dispensing opening and makes it difficult to strip additional papers from the stack even when the door is held open. The gate control mechanism is advantageously arranged to utilize the tray shifting mechanism for locking the tray against upward movement, when the gate is held open.

The gate 156 is rigidly secured to the rod and the rod is rotatably mounted in the side walls 25 and 26 to support the gate for swinging movement between a closed position as shown in FIG. 2 and an open position. The gate is arranged to swing upwardly to its closed position and has a lower portion 156*a* disposed below the rod 257 arranged to engage the door 30 and provide a stop for limiting upward swinging movement of the gate to its closed position. A latch keeper 158 is non-rotatably secured to one end of the rod 157 at the outer side of the side wall 26 and extends downwardly and rearwardly from the rod 157 in a direction away from the main portion of the dispensing gate. Latch keeper 158 preferably has a lateral portion 158*a* at its outer end to define an upwardly opening generally V-shaped notch.

A latch arm 159 is arranged for engagement with the latch keeper 158 to lock the gate against opening, except during a dispensing operation. Latch arm 159 is non-rotatably attached to one end of a shaft 161, which shaft extends through the side wall 26 and is rotatably supported in a bracket 162 for movement about a generally horizontal axis paralleling the rod 157 and laterally offset from the keeper 158. The latch arm 159 is movable from a first position engaging the keeper 158 as shown in solid lines in FIG. 3, to a second position shown in phantom in FIG. 3. A crank 163 is non-rotatably connected to the other end of the shaft 161 and the crank 163 has a lateral crank portion 163*a*. As best shown in FIGS. 2 and 3, the crank 163 extends forwardly from the shaft 161 so that the latch arm 159 is moved out of its latched position shown in FIGS. 2 and 3 when the crank 163*a* is raised. A substantially rigid member 164 is rigidly secured at one end 164*a* to the lever 121 at a location intermediate the pivot pin 122 and the finger 133 on the inner end of the lever 121. The member 164 extends forwardly and overlies the bracket 162 and has portions 164*b* and 164*c* at its forward end that respectively underlie and overlie the portion 163*a* on the crank 163.

The above described gate control mechanism performs several functions. It moves the latch arm 159 to its latched position to lock the gate 156 against opening movement when the dispensing mechanism is between dispensing cycles; it automatically moves the latch arm to a release position when the dispensing mechanism is moved forwardly in a dispensing stroke to thereby allow the gate to open for the passage of the paper therethrough, and it further operates when the gate is held open to prevent elevation of the support tray 76 toward the level of the dispensing opening. More particularly, when the carriage 45 is moved forwardly in a dispensing stroke, the arm 131 engages the finger 133 on the inner end of the lever 121 to raise the inner end of the lever and depress the toothed bar 114 to thereby depress the tray 76 and relieve the pressure between the top paper and the stack. In addition, when the inner end of the lever 121 is raised, the member 164 is also raised and this operates through portion 164*b* to engage the crank 163*a* and move the latch arm 159 to its release position to enable the gate 156 to move to its open position and thereby allow passage of the paper therethrough. Conversely, when the carriage 45 is retracted under the bias of spring 54, the inner end of the lever 121 is lowered and this operates through portion 164*c* on the member 164 to move the latch arm 159 to its latch position. If the gate 156 is held open after the dispensing mechanism is moved through its dispensing stroke, the latch arm 159 cannot move to its latch position but is instead held in a position adjacent its gate release position. This operates to hold the crank arm 163 in its raised position and, in turn, to hold the inner end of the lever 121 in a raised position. When the inner end of the lever 121 is raised, it depresses the toothed bar 114 so that it engages the pawl 115 on the tray and thereby holds the tray against upward movement. When the tray is held against upward movement, the stack of papers on the tray are not elevated to the level of the dispensing openings so that access to papers in the machine through the dispensing opening is impeded. It is difficult to remove papers even with a wire inserted through the open dispensing opening, when the top paper in the stack is substantially below the level of the dispensing opening. In this manner, theft of papers from the stack by holding the dispensing gate open, is minimized if not effectively prevented.

Conveniently the length and weight of the latch keeper 158 is made sufficient to slightly overbalance the dispensing gate to normally gravitationally urge the gate to its closed position. The vending machine is coin controlled and the coin control mechanism is advantageously of the type disclosed in the copending application of Elmer G. Etes, Ser. No. 594,535, filed July 9, 1975, and entitled "Plural Coin Responsive Mechanism For A Dispensing Machine", now U.S. Pat. No. 4,030,586, issued June 21, 1977, to which reference is hereby made for a more complete illustration and description of the coin operated mechanism. In general, the machine has a coin receiving slot 211 in the front panel 29, which slot is connected through a coin chute 212 shown in phantom in FIG. 3 to a coin mechanism designated generally by the numeral 213. Coins discharged from the coin mechanism pass into a coin collection box 215.

A latch mechanism is provided to normally prevent movement of the carriage 45 in a dispensing stroke or cycle and the coin responsive mechanism 213 is arranged to control operation of the latch to release the latch and allow movement of the dispensing member in a dispensing cycle only when the coin responsive mechanism senses a combination of coins having the proper monetary value. As best shown in FIGS. 2 and 4, the latch mechanism includes a latch finger 218 mounted on an arm 219 secured to a horizontal shaft 221 for vertical swinging movement about the axis of the shaft. The shaft 221 is conveniently mounted on the bracket 162 and a cam track 225 is mounted for movement with the carriage 45 and includes a first dwell portion 225*a* arranged to engage the latch finger 218 and support the same when the carriage 45 is in its fully retracted position shown in FIG. 2. The cam track 225 has a notch 225*b* that extends below the level of the dwell portion 225*a* and which defines a stop. The cam track also has a second dwell portion 225*c* that extends from the notch 225*b* in a direction rearwardly and parallel to the path of travel of the dispensing mechanism, and a cam face 225*d* which is arranged to engage the stop finger when the dispensing member approaches the end of its forward dispensing stroke to raise the latch finger.

As more fully disclosed in the aforementioned patent application, the shaft 221 is non-rotatably connected to an arm 229 and by a link 230 to a rod 231 on the coin operated mechanism 213. If no coins or an improper combination of coins is inserted through the slot 211 and chute 212 into the coin responsive mechanism, the rod 231 on the coin operated mechanism can move upwardly under the bias of spring 232 and this moves the finger 218 downwardly into engagement with the stop notch 225*b* on the cam track 225 to prevent forward movement of the carriage 45. Conversely, if the proper combination of coins is inserted to the coin responsive mechanism 213, the rod 231 is held against upward movement and this holds the finger 218 out of the stop notch **225*b* so that the carriage can move forwardly in a dispensing stroke. As the carriage approaches the end of its dispensing stroke, the cam face 225*d* engages the finger 218 to raise the finger and depress the rod 231 on the coin operated mechanism. As described more fully in the aforementioned application, depression of the rod 231 operates to discharge the coins from the coin operated mechanism into the coin box 215**. A coin return mechanism (not shown) more fully described in the aforementioned application, can also be provided.

From the foregoing it is thought the construction and operation of the vending machine will be readily understood. The machine is loaded by first opening the door 30 and then moving the handle 105 to release the latch and elevate the levers 103 to thereby lower the tray support arms 95. The tray moves downwardly as the arms are lowered and the stack of papers is then positioned on the tray with the folded edge of the papers disposed at the rear and overlying the offset 77 in the tray. The arms are thereafter elevated by moving the lever 103 back to the position shown in FIG. 2 and the springs apply a pressure to the tray sufficient to counterbalance the weight of the stack of papers and to press the top paper against the panel 28 with a slight pressure.

In order to remove the paper from the stack, coins of the proper denomination are inserted into the coin slot 211 and the knob 58 then pulled forwardly. As the carriage moves forwardly, the follower 65 on the arm 38 drops off the shelf and spring 21 moves the arm and feed finger downwardly with a snap action to impale the feed finger into the end paper. As the feed finger advances, the follower engages the cam surface which positively forces the feed finger 36 downwardly and further impales the same in the paper. At this point, the arm 131 on the carriage operates the lever 121 to depress the tray 76 a short distance sufficient to at least partially relieve the pressure between the stack of papers and the panel and thereby facilitate movement of the end paper off the stack. In addition, the upward movement of the inner end of the lever 121 operates through member 164 and crank 163 to raise the latch arm 159 out of its latching position and thereby allow opening of the gate 156 for the passage of the paper therethrough. At the completion of the forward dispensing stroke, the feed finger 136 is retracted from the end paper and out of the slot 37 by the cam plate 69. When the knob 58 is released, the carriage 45 is retracted back to its initial position by the spring 54 and, during retraction of the carriage, the finger 65 on the arm 38 rides on top of the cam track 66, out of engagement with the top paper. As the carriage approaches its retracted position, arm 131 allows the inner end of the lever 121 to move downwardly so that the toothed bar 114 can shift upwardly out of engagement with the pawl 115 on the tray whereby the tray is biased upwardly to elevate the top paper in the stack into engagement with the dispensing panel. In addition, the member 164 is moved downwardly to thereby move the latch arm 159 into its latch position shown in FIG. 2. The latch arm 159 is effective to lock the gate 156 against opening, if the gate is closed when the carriage reaches its retracted position. However, if the gate is held open as by a hand or other instrument being inserted through the dispensing opening, then the stop finger 159 is held in its release position shown in phantom in FIG. 3 and this operates through crank 163 and member 164 to hold the inner end of the lever 121 in its raised position and thereby maintain the toothed bar 114 depressed. In this manner, the tray 76 is prevented from moving upwardly under the bias of springs 93, whenever the gate is held open.

The embodiments of the invention in which an exclusive property or privilege is claimed are defined as follows:

1. In a machine for vending newspapers, magazines and the like including a housing having an elongated generally horizontal dispensing opening at a level substantially above the bottom of the housing, a dispensing gate mounted on the housing for movement between open and closed positions in the dispensing opening, a newspaper support tray for supporting a stack of generally horizontally disposed papers thereon, tray elevating means yieldably urging the support tray upwardly to elevate the stack until the top paper is adjacent the level of the dispensing opening, a feed mechanism operable through a dispensing cycle including a dispensing stroke to move the top paper at least part way off the stack and into the dispensing opening, and dispensing gate control means operative to prevent opening of the dispensing gate between dispensing cycles and operative when said feed mechanism is moved in its dispensing stroke to enable opening of the dispensing gate for the passage of the top paper therethrough, said dispensing gate control means including means operative whenever the dispensing gate is held open after the feed mechanism has completed its dispensing stroke for preventing elevation of the support tray toward the level of the dispensing opening whereby to impede access to the papers in the stack through the dispensing opening.

2. In a machine for vending newspapers, magazines and the like including a housing having an elongated generally horizontal dispensing opening at a level substantially above the bottom of the housing, a generally horizontal panel in said housing adjacent said dispensing opening, a dispensing gate mounted on the housing for movement between open and closed positions in the dispensing opening, a newspaper support tray for supporting a stack of generally horizontally disposed papers thereon, tray elevating means yieldably urging the support tray upwardly to elevate the tray toward the panel as the stack is depleted and for pressing the face of the top paper against the panel with sufficient pressure to compact the top paper, a feed mechanism operable through a dispensing cycle including a dispensing stroke to move the top paper at least part way off the stack and into the dispensing opening, tray shifting means engageable with the support tray in all operative positions thereof operable to shift the support tray from the position to which the tray is advanced by said yieldable means downwardly a preselected distance sufficient to at least partially relieve said pressure between the top paper and the panel, means operative during movement of said feed mechanism through said dispensing stroke for operating said tray shifting means to facilitate movement of the top paper relative to the panel and off the stack, and dispensing gate control means operative to prevent opening of the dispensing gate between dispensing cycles and operative when said feed mechanism is moved in its dispensing stroke to enable opening of the dispensing gate for passage of the top paper therethrough, said dispensing gate control means including means connected to said tray shifting means and operative whenever the dispensing gate is held open after the feed mechanism has completed its dispensing stroke for preventing elevation of the support tray toward the level of the dispensing opening whereby to impede access to the papers in the stack through the dispensing opening.

3. A machine for vending newspapers, magazines and the like according to claim 2 wherein said tray shifting means includes a rack bar paralleling the path of movement of said support tray, a pawl on said tray, and means for shifting the rack bar in a direction to engage the pawl and thereafter move the pawl and tray downwardly, said gate control means including means for maintaining the rack bar in engagement with the pawl whenever the gate is held open.

4. A machine for vending newspapers, magazines and the like according to claim 2 wherein said dispensing gate is mounted for pivotal movement about a generally horizontal axis between its open and closed positions, said gate control means including a latch member mounted on the gate for movement therewith; a latch arm movable to a latch position when the gate is in its closed position for engaging the latch member to lock said gate in its closed position, means responsive to movement of said feed mechanism in a dispensing stroke for moving the latch arm out of said latch position to enable opening of the dispensing gate, said latch member being operative to hold said latch arm out of its latch position when the dispensing gate is held open, and means operative when said latch arm is held out of its latch position for preventing elevation of the support tray.

5. A machine for vending newspapers, magazines and the like according to claim 4 wherein said tray shifting means includes a rack bar paralleling the path of movement of said support tray, a pawl on said tray, and means for shifting the rack bar in a direction to engage the pawl and thereafter move the pawl and tray downwardly, said gate control means including means for maintaining the rack bar in engagement with the pawl whenever the latch arm is held out of said latch position.

6. A machine for vending newspapers, magazines and the like according to claim 4 wherein said latch arm is mounted for swinging movement on said housing into and out of said latch position thereof.

7. A machine for vending newspapers, magazines and the like comprising: a housing having an elongated generally horizontal dispensing opening therein at a level substantially above the bottom of the housing, a dispensing gate mounted on the housing for movement between open and closed positions in the dispensing opening, a generally horizontal panel in said housing adjacent said dispensing opening, a paper support tray in said housing for supporting a stack of generally horizontally disposed papers, tray elevating means yieldably urging said tray upwardly toward said panel to elevate a stack of papers to the panel and for pressing the face of the top paper on the stack against said panel with a pressure sufficient to compact the end paper, a manually operable carriage mounted for reciprocation on said panel from a retracted position forwardly toward the dispensing opening and back, a feed finger mounted on the carriage for movement thereby, means responsive to movement of the carriage in a forward direction for sequentially moving the feed finger in a direction transverse to said panel to impale the end paper in the stack and for thereafter moving the feed finger a dispensing stroke along a path generally parallel to said panel to move the top paper at least partially off the stack and into said dispensing opening, a pawl attached to said tray, a rack positioned alongside the path of movement of said pawl and operative when depressed to sequentially engage the pawl and thereafter move the pawl and tray downwardly a distance sufficient to at least partially relieve said pressure between the top paper and the panel, a rack engaging member engaging said rack, means responsive to movement of said manually operable carriage in said forward direction for moving said rack engaging member to a rack depressing position, dispensing gate control means including a latch member mounted on the dispensing gate for movement therewith, a latch arm mounted on the housing and movable to a latch position engaging the latch member when the gate is closed to lock the dispensing gate in its closed position, latch operating means operatively connected to said rack engaging member and said latch arm for moving said arm out of said latch position when said rack engaging member is moved to its rack depressing position, said latch member being operative to hold said latch arm out of its latch position when the dispensing gate is held open, said latch operating means being operative when the latch arm is held out of its latch position to hold the rack engaging member in its rack depressing position and thereby prevent elevation of the support tray.

8. A machine for vending newspapers, magazines and the like according to claim 7 wherein said rack engaging member comprises a lever pivotally mounted intermediate its ends on the housing and having one end portion engaging the rack, said operating means engaging the other end of said lever, said latch operating means engaging said lever at a location intermediate said other end of the lever and the pivotal mounting thereof.

9. A machine for vending newspapers, magazines and the like according to claim 8 wherein said dispensing gate is pivotally mounted on said housing for movement about a horizontal axis, said latch arm being pivotally mounted on said housing for movement about a horizontal axis spaced from the axis of the gate.

10. A machine for vending newspapers, magazines and the like according to claim 7 wherein said rack engaging member comprises a lever pivotally mounted intermediate its ends on the housing and having one end portion engaging said rack, said latch operating means comprising an operating member rigidly attached to said lever at a location intermediate said other end of the lever and the pivotal mounting thereof, said gate being pivotally mounted on said housing for movement about a horizontal axis, said latch arm being pivotally mounted on said housing for movement about a horizontal axis spaced from the axis of said gate, a crank arm operatively connected to the latch arm for turning therewith about the axis of the latch arm and having a crank portion horizontally offset from the axis of the latch arm and means connecting the crank portion of the crank arm to said operating member.

* * * * *